United States Patent [19]

Hanås

[11] 4,243,092

[45] Jan. 6, 1981

[54] CONTINUOUS CASTING

[75] Inventor: Bertil Hanås, Vesterås, Sweden

[73] Assignee: ASEA Aktiebolag, Vesteras, Sweden

[21] Appl. No.: 10,907

[22] Filed: Feb. 9, 1979

[30] Foreign Application Priority Data

Feb. 10, 1978 [SE] Sweden ..... 7801554

[51] Int. Cl.[3] ..... B22D 27/02

[52] U.S. Cl. ..... 164/49; 164/147; 164/437

[58] Field of Search ..... 164/49, 147, 251, 437, 164/438, 439, 66, 82, 418; 266/233, 234; 222/591

[56] References Cited

U.S. PATENT DOCUMENTS

| | | | |
|---|---|---|---|
| 2,944,309 | 7/1960 | Schaaber | 164/147 |
| 3,486,660 | 12/1969 | Heintz | 164/147 |
| 4,015,655 | 4/1977 | Fastner et al. | 164/66 |

FOREIGN PATENT DOCUMENTS

| | | | |
|---|---|---|---|
| 2709727 | 9/1977 | Fed. Rep. of Germany | 164/437 |
| 42-25559 | 12/1967 | Japan | 164/66 |
| 52-25811 | 7/1977 | Japan | 164/437 |
| 705762 | 3/1954 | United Kingdom | 164/147 |

*Primary Examiner*—Robert D. Baldwin
*Assistant Examiner*—K. Y. Lin
*Attorney, Agent, or Firm*—Kenyon & Kenyon

[57] ABSTRACT

Molten metal is continuously cast by being flowed through a casting pipe leading into a continuous casting mold, the metal flowing through the pipe being inductively stirred with the stirring motion through the momentum of the metal continuing in the mold.

3 Claims, 1 Drawing Figure

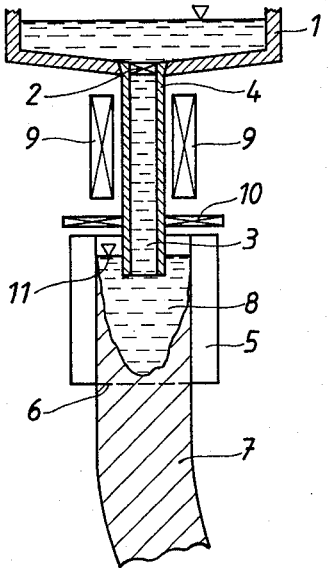
1
2
4
9
9
10
3
11
8
5
6
7

CONTINUOUS CASTING

BACKGROUND OF THE INVENTION

For continuous molten metal casting, using steel as an example, the molten metal is tapped via a bottom tapping hole from a molten metal container above a continuous casting mold, the latter having an open top and bottom and being designed so that the molten metal in contact with the mold solidifies to form a solid metal skin retaining unsolified molten metal and forming a strand which continuously travels from the bottom of the mold. The traveling strand ordinarily retains molten metal which gradually solidifies to form an entirely solid metal strand.

To prevent the molten metal from solidifying under static conditions within the skin, and forming an undesirable crystalline structure, it is possible to inductively stir the molten metal within the strand leaving the mold. Ordinarily this cannot be done very close to the mold and heretofore it has not been possible to stir the molten metal within the skin forming on the inside of the mold. The metal solidifying inside of the mold does not obtain the advantages of stirring.

Continuous casting molds are made of copper or at least incorporate a substantial amount of copper in their construction because the high heat conductivity of copper facilitates the removal of heat required for the continuously casting strand to travel from the mold without involving a serious risk of a molten metal breakout through the skin. For this reason it is impractical to attempt to inductively stir the molten metal within the continuous casting mold.

However, it would be desirable to stir the molten metal during its passage through the mold while the skin is initially forming.

SUMMARY OF THE INVENTION

The present invention provides for a continuous metal casting apparatus comprising a molten metal container having a bottom tapping hole, such as a bottom tapping ladle or a tundish. Instead of arranging this container rather directly above the continuous casting mold top for direct casting into the mold, the container is spaced a substantial distance above the top of the mold and a casting pipe depends from the tapping hole to the top of the mold and preferably partially into the mold, and it is through this pipe that the cast metal is conducted in the form of a flow of molten metal downwardly into the mold.

This flow of molten metal through the pipe is stirred in a direction transversely to the pipe's axis either by mechanically rotating the pipe or by the use of an inductive stirrer such as is used to stir the molten metal in the strand after it has left the mold. With the molten metal stirred, this stirring via the momentum of the stirring metal continues inside of the mold as the metal solidifies there to form the skin. Preferably the stirring is in a circular direction around the pipe's axis, effected by appropriate design of the inductive stirrer. For example, the stirrer can be made to encircle the pipe and constructed in the manner of the stator winding of a synchronous motor so that when provided with a rotating electric field, the molten metal is rotated. Preferably the pipe is made of electrically non-conductive material such as ceramic material.

With the flow of molten metal down through the pipe stirred circularly with a high peripheral velocity, the metal centrifugally presses against the inside of the pipe while descending through the pipe, and enters the mold. Through its momentum or flywheel effect, the metal enters the mold and there, because of its momentum, continues to rotate while descending through the mold with the consequent formation of the skin. In this way the metal is stirred while passing through the mold itself and depending on the rotative velocity, mold dimensions and other possible variables, with the rotative stirring continuing inside the strand's skin even after leaving the bottom of the mold, in the event complete solidification is not effected within the mold.

To further this internal stirring within the mold, the bottom of the pipe can be extended downwardly through the mold top and partially into its interior and preferably so as to dip into the molten metal continuously casting downwardly through the mold. The molten metal container from which the metal is cast is preferably provided with a means for controlling the flow of the casting metal or, in other words, a controllable valve. In this way the level of molten metal within the mold can be adjusted so that it is maintained a little above the bottom of the casting pipe. In this way the rotating molten metal is, in effect, made a part of the molten metal in the mold so that the rotative stirring prevails with good efficiency inside the mold and even possibly downwardly beyond the mold. Thereafter, it is possible to inductively stir any remaining molten metal in the strand which has left the mold so that during the entire solidification of the molten metal, there is hardly any time when the metal solidifies under static conditions.

BRIEF DESCRIPTION OF THE DRAWINGS

The accompanying drawing in an entirely schematic manner in vertical section illustrates the foregoing.

DETAILED DESCRIPTION OF THE INVENTION

The tundish or ladle is shown at 1 as having a bottom tapping hole 2 with the molten metal flowing down at 3 via the casting pipe 4. The container 1 is spaced a substantial distance above the continuous casting mold 5 from the bottom 6 of which the continuously cast strand 7 travels. The cast metal 8 continuously solidifies to form the skin due to the abstraction of heat from the metal 8 by the mold 5 which can be water-cooled and wholly or largely of copper construction as required for efficient heat removal.

The electric induction stirrers are shown at 9 and it is to be understood that these are arranged for stirring of the metal flowing down through the pipe 4, in a direction transverse with respect to the pipe's axis. As previously indicated, the stirring is preferably circular so that the metal acquires a swirling or rotative motion while flowing down through the pipe 4. All of the stirring is effected above the top of the mold 5. A valve 10 is indicated for the purpose of controlling the level 11 of the molten metal 8 within the mold 5, the bottom end of the pipe 4 dipping down somewhat below the level 11.

It would be possible to control the metal flow by the conventional stamper or sliding valve with which ladles are normally provided, such a valve being represented by the cross lines shown in the tap hole 2. However, it is preferable to use the valve 10 positioned adjacent to the bottom end of the pipe 4. A practical form of valve is the magnetic valve disclosed by the Granstrom et al. U.S. Pat. No. 3,701,357, Oct. 31, 1972.

With the above location of the valve, indicated at 10, the pipe 4 can be made with a larger diameter than would otherwise be possible so that the downward flow travel is slower and there is more space for the stirrers around the pipe. In this way it is possible to give the metal flow a high rotative speed of stirring so as to assure that the rotation continues effectively inside the mold and throughout its length containing molten metal.

As previously indicated, the flow can also be rotated by physical rotation of the pipe 4.

What is claimed is:

1. A continuous casting method comprising casting molten metal through a pipe extending downwardly to the top of a continuous casting mold from above the mold's top, with the metal flowing through the pipe and into the mold and the pipe being smaller in cross-sectional area than the mold's cross-sectional area, and stirring the molten metal while flowing through the pipe, the metal forming a solidified skin containing molten metal in the mold and leaving the mold as a continuously traveling strand, said stirring being directed transversely through the flow through the pipe and restricted to the flow in the pipe above the level of the molten metal in the mold, said stirring being effected by inductively stirring the flow in the pipe in a direction that is rotative around the pipe's axis and at a high rotative velocity so that by momentum the stirring continues in the molten metal in the skin forming in the mold.

2. A continuous metal casting apparatus comprising a molten metal container having a bottom tapping hole, a casting pipe depending from said hole for conducting a flow of molten metal downwardly therefrom, a continuous casting mold spaced below said container and fed with said flow of molten metal via the bottom end of said pipe, said pipe having a smaller cross-sectional area than the mold, and means for stirring said flow while in said pipe, said stirring by said means being rotatively about the axis of said pipe and said bottom end of the pipe extending downwardly within the upper portion of said mold, said tapping hole having means for controlling the molten metal flowing therethrough and said means for stirring being an inductive stirrer on the outside of the pipe.

3. The apparatus of claim 2 in which adjacent to its bottom end said pipe has said means for controlling the molten metal flow therethrough, and said pipe has a diameter causing it to be full of the molten metal while said mold receives therefrom metal maintaining a continuous liquid level in said mold.

* * * * *